United States Patent [19]

Hammer

[11] Patent Number: 4,552,485

[45] Date of Patent: Nov. 12, 1985

[54] PROCESS AND PREPRESSING PIPE FOR LAYING A PIPELINE IN THE EARTH

[75] Inventor: Heiner I. Hammer, Seevetal, Fed. Rep. of Germany

[73] Assignee: Schlegel Lining Technology GmbH, Hamburg, Fed. Rep. of Germany

[21] Appl. No.: 436,039

[22] Filed: Oct. 22, 1982

[30] Foreign Application Priority Data

Oct. 23, 1981 [DE] Fed. Rep. of Germany ..... 3142177

[51] Int. Cl.[4] ..... B63B 35/04; E21D 11/00; F16L 55/00; F16L 1/02

[52] U.S. Cl. ..... 405/184; 405/135; 405/154; 285/55; 138/109

[58] Field of Search ..... 405/133, 135, 136, 146, 405/150, 151, 152, 154, 184; 285/55, 336, 369; 138/109, 141, 144

[56] References Cited

U.S. PATENT DOCUMENTS

| | | | |
|---|---|---|---|
| 406,140 | 7/1889 | Howell | 285/55 X |
| 2,789,844 | 4/1957 | Kessler | 285/336 |
| 3,177,902 | 4/1965 | Rubenstein . | |
| 3,516,690 | 6/1970 | Kreig | 285/55 |
| 3,858,912 | 1/1975 | Bower | 285/336 X |
| 3,965,555 | 6/1976 | Webster et al. | 285/55 X |
| 4,091,630 | 5/1978 | Nemoto et al. | 405/184 |
| 4,195,850 | 4/1980 | Berger et al. | 405/135 X |
| 4,363,565 | 12/1982 | MacKenzie | 405/152 X |
| 4,388,021 | 6/1983 | Weiss . | |

FOREIGN PATENT DOCUMENTS

| | | | |
|---|---|---|---|
| 683461 | 6/1966 | Belgium . | |
| 682565 | 10/1939 | Fed. Rep. of Germany . | |
| 872706 | 4/1953 | Fed. Rep. of Germany . | |
| 6913721 | 3/1969 | Fed. Rep. of Germany . | |
| 7323206 | 9/1973 | Fed. Rep. of Germany . | |
| 2553934 | 8/1976 | Fed. Rep. of Germany | 405/152 |
| 2317041 | 8/1976 | Fed. Rep. of Germany . | |
| 3002231 | 7/1981 | Fed. Rep. of Germany . | |
| 2365073 | 4/1978 | France . | |
| 617492 | 5/1980 | Switzerland | 405/135 |
| 1393363 | 8/1971 | United Kingdom . | |

*Primary Examiner*—Cornelius J. Husar
*Assistant Examiner*—Nancy J. Stodola
*Attorney, Agent, or Firm*—Cumpston & Shaw

[57] ABSTRACT

A process for laying a prepressed pipeline and pipe advantageously employed therein are described. Concrete pipe sections have an inner lining of a polymeric material anchored by flexible projections to the inner surface of the pipe. The thickness of the lining is increased at the ends of the pipe to form an elongated sealing surface and a stress absorbing region. A compression seal may thereby be employed. Stresses created by the seal are absorbed both by the thickened region and by a shoulder formed in the concrete wall of the pipe. In use, compression is maintained as the result of friction between the pipe well and the surrounding earth.

8 Claims, 1 Drawing Figure

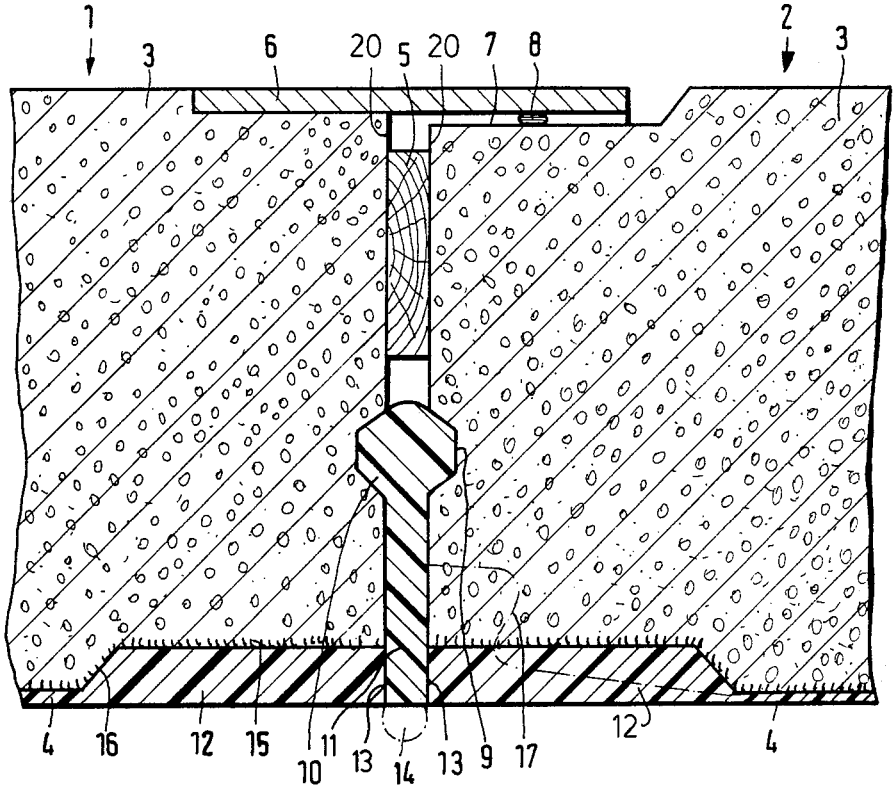
1
3
6
20
5
20
7
8
2
3
4
16
12
15
10
11
13
14
13
9
17
12
4

PROCESS AND PREPRESSING PIPE FOR LAYING A PIPELINE IN THE EARTH

DESCRIPTION

The invention relates to a process for laying a pipeline in the earth by means of prepressing of a plurality of pipe pieces joined together at their ends and having a thin inner lining made of polymeric material, such as polyethylene, these linings forming at the pipe ends joined together, by means of an end portion extending essentially axially, lining end faces located at a distance opposite one another, and for making a leak-proof connection between these lining end faces. The invention also relates to a prepressing pipe for carrying out this process, which has a shell made of load-bearing material, such as concrete, and a lining which is thin in comparison with this and is made of a polymeric material, such as polyethylene, and forms a lining end face at each pipe end by means of an end portion extending essentially axially.

In the prepressing process, pipeline portions consisting of several pipe pieces joined together at their ends are pressed hydraulically into a cavity driven simultaneously into the earth by means of a cutting head at the start of the pipeline. The pressing forces occurring thereby are absorbed by the load-bearing material of the pipe portions, usually concrete. The lining which consists of a material soft in comparison with the load-bearing material practically does not participate in absorbing the prepressing forces. The joined-together ends of adjacent pipe pieces are located opposite one another with their end faces, the prepressing forces having to be transmitted between the end faces of the pipe part consisting of the load-bearing material. A pressure compensation ring made, for example, of wood is generally inserted between these end faces. To maintain the joined position of the pipe ends, one of them can be provided with a steel sleeve which surrounds the other pipe end. As a protection against the penetration of dirt from outside and for the purpose of pressure compensation, an elastic ring can be inserted between the inner periphery of the sleeve and the outer periphery of the outer pipe end located therein.

The polymeric lining of the pipe is intended to protect the load-bearing material from corrosive attack by the medium to be expected in the pipeline. It is therefore necessary to connect to one another in a leak-proof manner the lining ends adjacent to the joined-together ends of adjacent pipe portions. It is known (German Utility Model No. 69 13 721) to effect this by welding the lining ends by means of extruder welding. This welding is carried out after the laying of the pipe and is complicated and expensive. Furthermore, this type of leak-proof interconnection between the linings of adjacent pipe pieces prevents them from being used in those regions where appropriate welding equipment and welders are not available.

The object on which the invention is based is, therefore, to provide a process and a prepressing pipe of the type mentioned in the introduction, which allow leak-proof interconnection between the pipe linings for a lower outlay.

The process according to the invention is characterised in that the end portions of each lining are thickened in comparison with their average thickness in the region between their end portions, and in that an elastic sealing strip is inserted, before the start of prepressing, between the lining end faces of the pipe ends joined together, and this sealing strip is compressed by means of the prepressing force so as to produce the compressive sealing force and is subsequently kept in the compressed state as a result of the pipe friction in the earth.

The prepressing pipe according to the invention is characterised in that the end portions are thickened in comparison with the average thickness of the lining between the end portions.

The process according to the invention is extremely simple, because the leak-proof connection is automatically obtained in one operation by means of the prepressing process, using parts which can be prefabricated. The sealing depends only on the surface quality of the lining end faces, on the surface quality of the sealing strips and on the easily calculated degree of compression of the sealing strip. With appropriate checking and, if appropriate, preparation of the interacting sealing surfaces, a sealing reliability which can be calculated directly beforehand and which can be guaranteed is therefore obtained.

Designing the lining end portions with increased thickness is functionally related to the process steps guaranteeing the compressive sealing force inasmuch as, on the one hand, a certain minimum amount of sealing surface must be available in the form of the lining end face, to guarantee sufficient sealing reliability, and, on the other hand, because the high sealing forces caused as a result require a corresponding resistance capacity of the lining end portions. This resistance capacity relates, on the one hand, to the forces acting axially. The axial compression of the lining end portions, which is to be expected under the sealing forces, must be so slight that the sealing forces can be transmitted from the lining to the load-bearing pipe part over a considerable axial length. The thickness of the lining ensures that the compression of the lining material is kept slight and therefore a large peripheral surface is available for force transmission. On the other hand, the resistance capacity of the lining end portions in a radial direction is just as important. If the lining is as thin in the end portions as it is in the remaining lining region, there is a fear that the lining will bulge radially inwards under the sealing forces. On the other hand, the compressive sealing force and consequently leak-tightness are lost as a result. On the other hand, the cohesion between the lining and the load-bearing pipe part is destroyed thereby. Harmful medium can penetrate from the pipe interior through the leaky point into the gap between the partially loosened lining and from there cause progressive loosening. Finally, the advantage of the thickening of the lining end portions is that the axial sealing forces can at least partially be transmitted axially at those interfaces between the lining and the load-bearing pipe part at which the lining thickness is reduced from the end portions to the normal thin dimension and which therefore have a radial direction component.

It is especially advantageous to employ the invention in relation to those linings which are anchored to the load-bearing material by means of flexible projections, for example, by means of pins, bristles, hairs or loops, which project from the lining and are anchored in the concrete. This anchoring is also appropriately located in the region of the end portions.

A thickness of the thickened portions of approximately 10–30 mm on average has proved appropriate, especially in the case of polyethylene. According to the invention, the length of the thickened end portions will be at least approximately twice as great as their average thickness. It is also expedient if the thickness of the thickened end portions is approximately 3–8 times as great as the average lining between the end portions.

There, the thickness is preferably approximately 2–5 mm.

According to a further feature of the invention, at least one pipe end face can have a device for retaining the elastic sealing strip, for example, preferably an annular groove which interacts with the thickened cross-sectional part of the sealing strip.

So that the sealing strip cannot be damaged by the prepressing force and a predetermined compression can be expected, the pipe ends are appropriately provided with stop faces for maintaining a predetermined axial distance between the lining end faces.

The invention is explained in more detail below with reference to the drawing which illustrates an advantageous exemplary embodiment. A FIGURE represents a partial section through the joining region of two pipe pieces in a sectional plane extending axially and radially.

Pipes of comparatively large diameter and large wall thickness are concerned here, for example for collecting sewers with a clear diameter of a few meters and a wall thickness of, for example, 20–50 cm. The adjacent ends 1 and 2 of two pipe pieces will be seen, and the load-bearing wall part 3 of each of the latter consists of concrete and has on the inner surface a lining 4 made of polymeric material, such as, for example, polyethylene or polypropylene. The thickness of the lining is 2 to 4 mm everywhere, with the exception of the end portions. It is connected firmly to the concrete, specifically preferably by means of filaments projecting in the manner of brushes from the lining surface, according to German Offenlegungsschriften Nos. 2,432,648 and 3,114,003. The pipes are intended for laying by the prepressing process, in which pipes runs of considerable length, consisting of a plurality of individual pipe pieces, are pushed forward hydraulically in the earth in a tunnel made at the same time by shield driving. A wooden ring 5 is inserted between the pipe end faces 20 to transmit the pressing forces simultaneously. The pipe end faces form, together with the wooden ring, a stop device which determines the distance between the pipe end faces. A steel ring 6 is located on the pipe end 1 to form a projecting collar. This surrounds the narrowed region 7 of the pipe end 2, a rolling ring gasket 8 being enclosed between them. As a result, the pipe ends are centered relative to one another and sealed off from water occurring on the outside. The pipe end faces 20 contain, at a moderate distance from the inner surface of the pipe, at a point located opposite, an annularly encircling groove 9 for receiving the thickened part 10 of an annular sealing strip, the sealing part 11 of which is located between those parts of the pipe end faces 4 which are radially within the grooves 9.

The end portions 12 of the pipe linings 4 are thickened, so that they form in the pipe end faces 20 lining end faces 13 which interact, as annularly encircling sealing faces, with the sealing part 11 of the sealing strip. In the example illustrated, the end portions 12 of the pipe linings are connected to the inner surface of the load-bearing pipe part 3 in the same way as the lining in its normal thin region 4. However, other fastening devices can also be used. It is important that the forces exerted by the sealing strip 11 on the end portions 12 can be transmitted to the load-bearing pipe part 3 without harmful deformation of the end portions 12. For force transmission, the connecting devices 15 (projections, monofilaments, etc.), on the one hand, and the axial projection of the annular surface 16, on the other hand, are available. The greater the thickness difference between the normal thin part 4 and the thickened end portion 12 of the lining, the greater also the radial extension of the annular surface and consequently its capacity for transmitting the sealing forces. However, the end portions 12 cannot be made as thick as desired, because as a result, on the one hand, the cross-section, necessary for force transmission, of the load-bearing pipe wall part 3 is reduced and, on the other hand, production of the thickened part 12 of the lining becomes more expensive. The thickness of the thickened end portion 12 of the lining is therefore calculated as small as is necessary with regard to the necessary minimum size of the lining end face 13 serving as a sealing surface and as regards the strength of this end portion in relation to the sealing forces.

These sealing forces first act in an axial direction on the lining end faces 13. They therefore have to be transmitted primarily as shearing forces between the outer peripheral surface of the end portion 12 to the associated inner surface of the load-bearing pipe part 3, by means of the filaments 15. If the lining is very thin near the lining end faces 13, there is a danger that the lining will be deformed under the sealing forces and will possibly bulge radially inwards, the connection with the load-bearing pipe wall part being broken in the bulging region. In contrast to this, the thickening according to the invention of the end portion ensures that the stability is sufficiently great to be capable of withstanding the tendency towards bulging. Moreover, this guarantees that the axial compression of the relatively flexible lining material can take place uniformly over a long axial length, so that the sealing forces can be transmitted from the lining to the load-bearing part 3 of the pipe wall over a correspondingly long axial length.

An end portion 12 with a thickness of 30 mm and a length of 80 mm has proved appropriate in practice when polypropylene is used as the lining material and when polyethylene is used as the material for the monofilaments forming the connecting devices 15, and when the lining has a thickness of 3 mm in the normal thin region 4, the angle between the annular surface 16 and the axial direction in the sectional plane being approximately 25°. Under these conditions, the deformation of the end portion 12 under the axial compression forces acting from the sealing strip 11 is very slight, so that the entire outer peripheral surface of the end portion 15 and also the annular surface 16 can be utilized for force transmission.

Especially good force transmission between the thickened end portion and the load-bearing part of the pipe wall is achieved if the end portion of the lining, as indicated by a dot-and-dash line at 17, has a large difference in diameter from the normal lining thickness at 4, and the undercut shape of the interface between the thickened portion of the lining and the load-bearing pipe part is also advantageous for force transmission. However, it is very expensive to produce such a thickening of the lining, and the cheaper design shown mainly in the drawing is generally sufficient.

The sealing strip can be shaped so that the highest compressive sealing force is generated in the region of the lining end faces 13. This is achieved, for example, by making the region of the sealing strip intended to be located between these lining end faces somewhat thicker in comparison with the remaining part 11.

The laying process is carried out by first laying together at least two pipe pieces with their pipe ends fitting one another, the wooden ring 5 and the sealing strip 10, 11 being included, but because of the axial thickness of the sealing strip 10,11 which is greater in the unstressed state the pipe end faces 20 are not yet in contact with one another or in contact with the wooden ring 5. At the start of the prepressing process, the pipe end faces 20 are brought nearer one another under the prepressing pressure, until the wooden ring 5 rests firmly against them on both sides. During the time when they are brought nearer one another, the sealing strip 10,11 consisting of elastomeric material is compressed, and it generates between the lining end faces 13 a compressive sealing force which can easily be calculated from the dimensions of the sealing strip, its elasticity and the degree of compression and which is predetermined so that a desirably sealing effect is achieved. It may happen, during this time, that a part of the sealing strip, indicated by a dot-and-dash line at 14, swells inwards into the clear pipe cross-section. After the pipe laying has been completed, this part can, if desired, be cut off. When the prepressing process has ended, the compressive sealing force of the sealing strip 10,11 is maintained, because the friction of the pipe pieces against the surrounding earth is greater than the axial force generated by the sealing strip.

I claim:

1. Pipe for use in laying a prepressed pipeline in the earth comprising:

a load bearing shell having an inner surface; an at least substantially even outer surface and first and second longitudinal force transferring end faces;

a layer of polymeric material adjacent to said inner surface, said layer characterized by a first average thickness over a substantial portion of said pipe between said end faces and end portions of greater thickness proximate said end faces; and a plurality of flexible projections extending from said layer into said shell for anchoring said layer to said shell.

2. Pipe according to claim 1, wherein the thickness of the thickened end portions (12) is approximately 10–30 mm on average.

3. Prepressing pipe according to claim 2, wherein the length of the thickened end portion (12) is at least approximately twice as great as its average thickness.

4. Prepressing pipe according to claim 1, wherein the thickness of the thickened end portion (12) is approximately 3–8 times as great as the average thickness of the lining (4) between the end portions.

5. Pipe according to claim 1 wherein at least one end incorporates means (9) for retaining an elastic sealing strip (10,11).

6. Pipe according to claim 5 wherein said means for retaining an elastic sealing strip comprises an annular groove.

7. Pipe according to claim 1 wherein said pipe ends comprise stop surfaces for maintaining a predetermined axial distance between the ends of said linings.

8. Pipe according to claim 1 wherein said load bearing shell comprises a hollow concrete cylinder.

* * * * *